US005119736A

United States Patent [19]

Chiodi

[11] Patent Number: 5,119,736

[45] Date of Patent: Jun. 9, 1992

[54] MOTOR-DRIVEN BOGIE WITH INDEPENDENT WHEELS FOR PLATFORM CARS

[75] Inventor: Giuseppe Chiodi, Milan, Italy

[73] Assignee: FI. RE. MA. System S.p.A., Italy

[21] Appl. No.: 667,484

[22] Filed: Mar. 11, 1991

[30] Foreign Application Priority Data

Mar. 13, 1990 [IT] Italy ..... 20800/90[U]

[51] Int. Cl.[5] ..... B61F 3/12

[52] U.S. Cl. ..... 105/158.2; 105/133; 105/453; 105/199.1; 105/182.1; 105/218.2

[58] Field of Search ..... 105/133, 140, 138, 172, 105/158.2, 136, 157.1, 84, 96, 199.1, 158.1, 174, 175.1, 180, 182.1, 211, 208.1, 208, 206.1, 202, 200, 218.1, 218.2, 224.1, 453

[56] References Cited

U.S. PATENT DOCUMENTS

| | | | |
|---|---|---|---|
| 2,374,218 | 4/1945 | Ledwinka | 105/182.1 |
| 3,835,788 | 9/1974 | Paul et al. | 105/139 |
| 4,941,409 | 7/1990 | Richter et al. | 105/157.1 |

FOREIGN PATENT DOCUMENTS

| | | | |
|---|---|---|---|
| 0183619 | 6/1986 | European Pat. Off. | 105/157.1 |
| 0334418 | 9/1989 | European Pat. Off. | 105/158.2 |
| 0413337 | 2/1991 | European Pat. Off. | 105/133 |
| 0360965 | 11/1938 | Italy | 105/218.2 |
| 0195367 | 6/1983 | Italy . | |
| 8705873 | 10/1987 | PCT Int'l Appl. | 105/133 |
| 9102673 | 3/1991 | PCT Int'l Appl. | 105/133 |

*Primary Examiner*—Robert J. Oberleitner
*Assistant Examiner*—Mark T. Le
*Attorney, Agent, or Firm*—Shlesinger, Fitzsimons & Shlesinger

[57] ABSTRACT

A bogie for railway platform vehicles has mounted on its frame a swinging transom having a central portion thereof connected to the body of a platform vehicle. The transom has opposite sides thereof shaped in the form of inverted, generally L-shaped supports to the upper ends of which are connected by a suspension to the upper surfaces of two box-shaped elements which are secured to opposite sides, respectively, of the bogie frame. The frame is supported for movement on a plurality of wheels, each of which is supported for rotation in one end of a U-shaped arm, the opposite end of which is connected by a coupling and a primary suspension to the upper surface of one of the box-shaped elements.

7 Claims, 2 Drawing Sheets

MOTOR-DRIVEN BOGIE WITH INDEPENDENT WHEELS FOR PLATFORM CARS

BACKGROUND OF THE INVENTION

This invention refers to a bogie for a railway platform car. In the manufacturing of bogies of the type used for railway vehicles there are known bogies in which the central part between the wheels is lower than the axis of rotation of the wheels themselves (as for example described in the Italian industrial utility model patent No. 195367 on behalf of the same Applicant), so as to enable the production of the platform cars. In order to be motor-driven these bogies obviously require independent motors for each wheel since it is not possible to connect the wheels on both sides by means of an axle.

So as not to encumber the space between the wheels and thus keep it as free as possible for the internal volume of the vehicle it is necessary to position the motors to the side of the bogie.

In bogies of known technique however there are numerous problems. For example, in several known embodiments the sides of the bogie are excessively high and consequently these bogies can only be used inside revolving couplings in articulated vehicles since otherwise the bogie is unable to turn to describe a curve. Another problem is the structural complexity and/or difficult maintenance due also to the very close and interdependent disposition of the various parts, which makes them difficult to be reached and to be removed. In known bogies of the aforesaid type there are also various other problems concerning their shock absorbing functions which are essential for travelling comfort. For example, in order to decrease the dimensions, bogies have been designed in which each traction motor is rigidly mounted on the wheel which in turn is interconnected to the rest of the bogie with interposition of shock absorbers. Although this solution offers a certain reduction in the dimensions, it is extremely disadvantageous in terms of comfort due to the considerable mass rigidly connected to the wheel.

Moreover, due to the intense vibrations transmitted to the motor the lifespan of the latter is considerably shortened.

For these reasons, a bogie made in this way gives rather poor results even in low-speed vehicles, such as urban public transport vehicles, and is totally unserviceable in relatively high-speed vehicles, such as railway vehicles. The general scope of this invention is to obviate the aforementioned problems by providing a bogie with independently driven wheels for the construction of railway platform cars, which is of limited dimensions, easy to construct and to service, suitable both for low and for high-speed uses and ensuring smooth, comfortable running.

SUMMARY OF THE INVENTION

This scope is achieved according to the invention by providing a bogie with each wheel individually connected to a corresponding drive motor, for use in railway platform vehicles, of the type comprising a swinging transom with a lowered central portion carrying a fifth wheel which is rotatingly connected to the body of the vehicle, the two ends of the swinging transom being connected, with interposition of first vertical suspensions, to two box-shaped elements interconnected by a frame substantially laterally surrounding the fifth wheel, each box-shaped element pivotingly supporting in opposite directions and parallelly to the direction of movement two generally U-shaped arms each supporting a wheel, characterized by the fact that the swinging transom has both ends shaped in the form of an overturned L which each fit over a box-shaped element and comprise between the ends and the upper surfaces of the underlying box-shaped elements the aforesaid first suspensions, each U-shaped arm comprising coupling arms disposed at the side of its respective wheel and directed upwards and pivoted to a second suspension disposed horizontally and connected to the upper surface of the box-shaped elements.

The innovatory principles of this invention and its advantages with respect to the known technique will be more clearly evident from the following description of a possible exemplificative and non-restrictive embodiment applying such principles, with reference to the accompany drawings.

THE DRAWINGS

PREFERRED EMBODIMENT OF THE INVENTION

Figure 1:
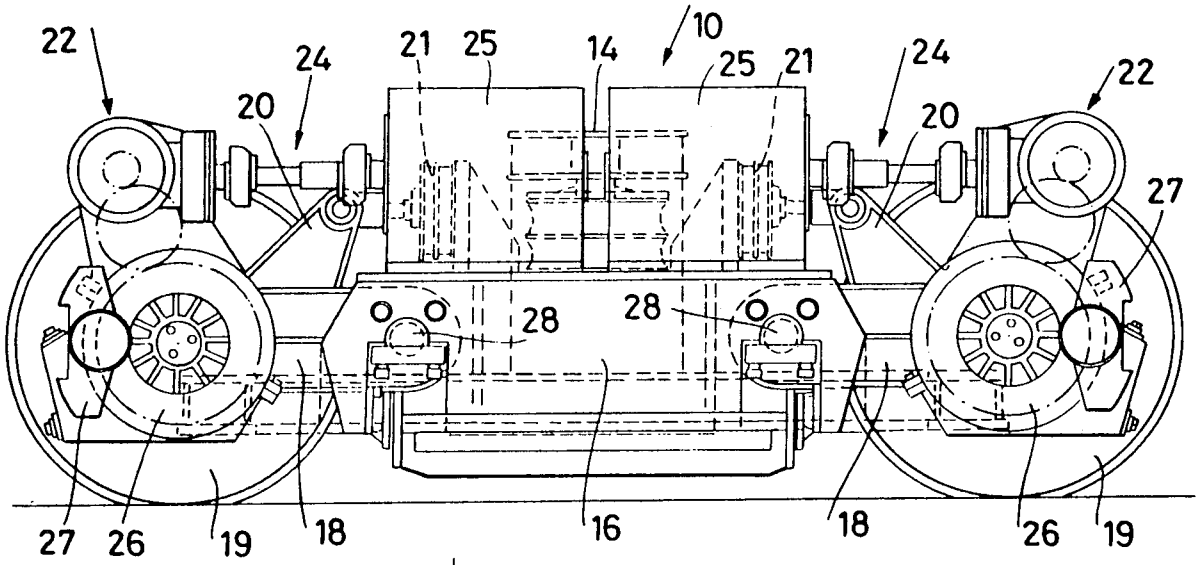
FIG. 1 shows a schematic side elevation view of a bogie made according to the innovatory principles of the invention.

In the description and in the accompanying drawings reference is made to one half of the bogie since the other half is perfectly symmetrical with respect to a longitudinal plane.

With reference to the figures, a bogie with independently driven wheels, generally indicated by reference 10, comprises a swinging transom 11 with a central portion rotatingly connected, by means of a fifth wheel 12 of known technique, to a body 13 (shown by the broken line in FIG. 2) of a vehicle. The two ends of the swinging transom 11 at opposite sides, respectively, thereof, are shaped in the form of an upturned L so as to define supports 14 which are connected, with interposition of a secondary vertical suspension 15, to box-shaped elements 16 interconnected by a frame 17 laterally surrounding the fifth wheel 12.

Figure 3:
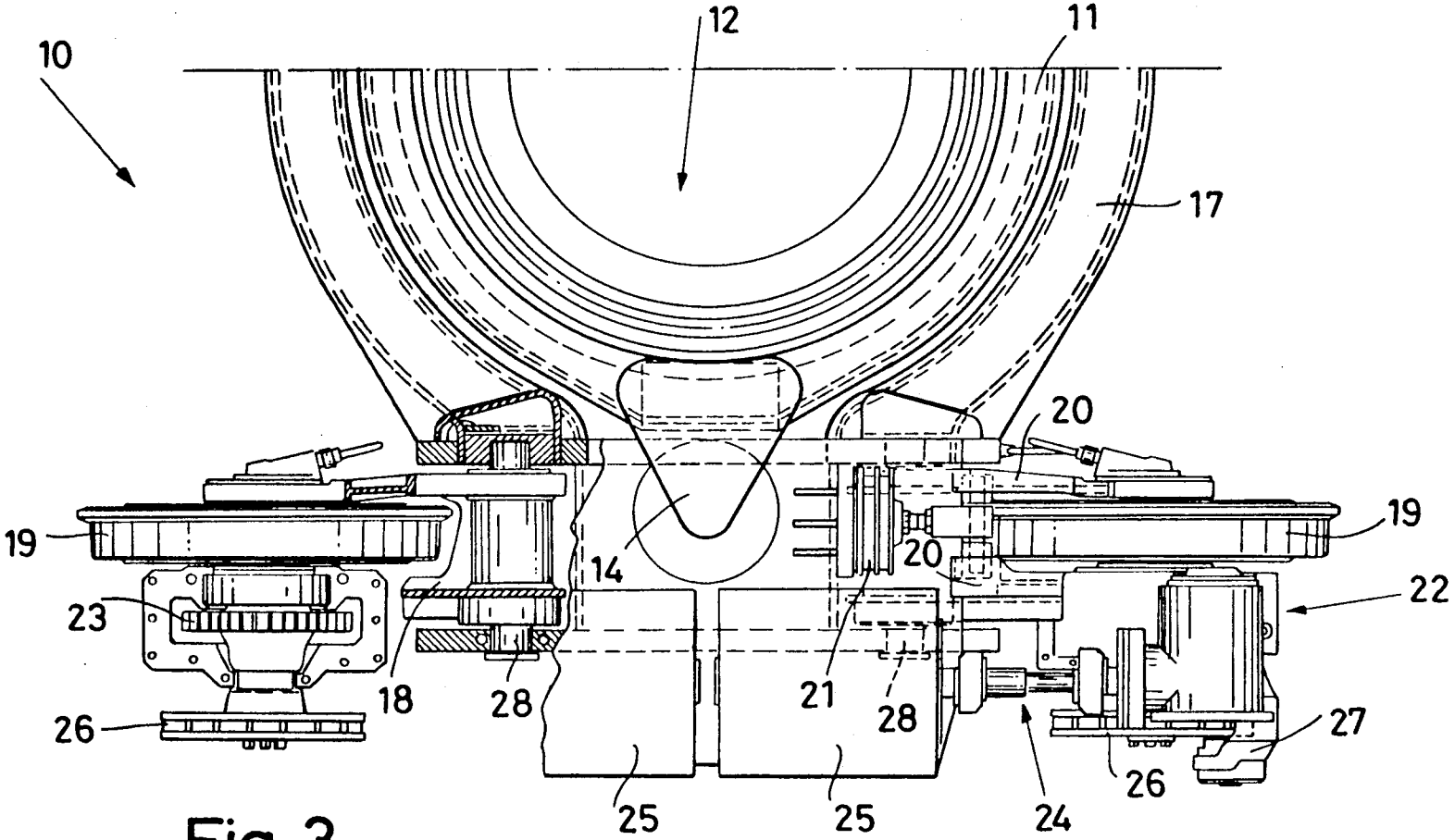
FIG. 3 shows a schematic partial plan view of one half of the bogie of FIG. 1.

Each box-shaped element 16 pivotingly supports two generally U-shaped arms 18 (as can be clearly seen in FIG. 3) each supporting a wheel 19.

Each U-shaped arm 18 is provided from above with couplings 20 disposed at the sides of its respective wheel to pivotingly connect it to a primary suspension 21 horizontally disposed on the upper surface of the box-shaped elements 16.

Figure 2:
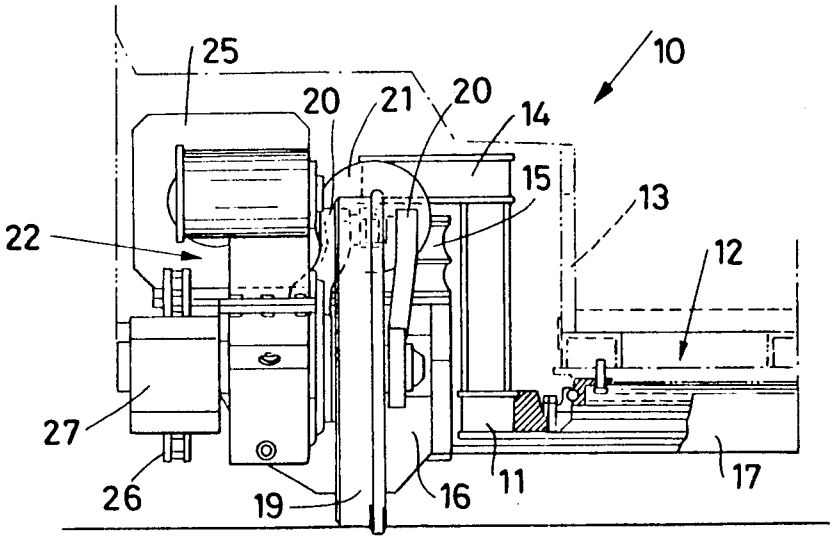
FIG. 2 shows a schematic partial front elevation view of one half of the bogie of FIG. 1.

Thus, each wheel 19 is elastically supported on the frame 17 which in turn supports, by means of the secondary suspensions, the body of the vehicle which can extend between the wheels on either side of the bogie according to a depressed plane, as shown schematically by the broken line in FIG. 2.

Each wheel 19 is driven by a corresponding motor 25 which is secured to the upper surface of the box-shaped element 16 and connected to the wheel by means of a homokinetic flexible coupling shaft 24, and a reduction gear casing 22 supported by the U-shaped arm which holds the wheel.

The motors 25 are advantageously electric motors. The reduction gear casing 22 comprises a mechanism of known technique, such as for example a bevel gear pair for rotation by 90° of the axis of rotation and a plurality of reduction gears, the last of which, indicated by reference 23 in FIG. 3 (where for the sake of clarity the upper part of the hub of the wheel has been removed and cut away), is keyed coaxially to the axle of the wheel.

The axle of the wheel continues beyond the reduction gear casing and ends with a disc brake 26 whose shoe 27 is integral with the U-shaped arm supporting the wheel.

It is clear that is it thus easy to remove the entire wheel unit complete with brake and gearbox from the bogie in order to replace or repair it. To do so, it is sufficient to disconnect the coupling 24 and the obvious flexible connections (not shown) to operate the calipers 27 and, if necessary, to lubricate the rotating parts and free the pivot 28.

Moreover, the reduction gear casing 22 is openable from below (as can be clearly seen on the left hand side of FIG. 3) thus making it possible to remove the unit made up of the wheel, the gear 23 and the disc brake 26, so as to be able to quickly change the wheel.

Lastly, since the motors are positioned completely on the outside of the bogie, they can be quickly replaced in the event of failure.

Buffers and limit switches (not shown since they are easily imaginable by the technician) for limiting the extreme movements of the suspensions and the frame with the box-shaped elements with respect to the swinging transom are obviously provided.

It will be clear from the foregoing description that the intended scopes have been achieved by making the various parts of the bogie easily accessible and removable while at the same time reducing the dimensions and offering excellent running characteristics by the use of primary and secondary suspensions and with the motors completely elastically suspended, which minimizes the stress transmitted to the rails and the points.

The foregoing description of an embodiment applying the innovatory principles of this invention is obviously given merely by way of example in order to illustrate such innovatory principles and should not therefore be understood as a limitation to the sphere of the invention claimed herein.

For example, even though the motors can advantageously be of the conventional electric type, it is also possible to use other types such as hydraulic motors or gas turbine engines.

Moreover, the drive system can also be achieved by means of other systems of known technique such as for example belt or hydraulic drive systems instead of by means of a gearbox.

I claim:

1. A bogie having a frame supported for movement on a plurality of wheels, each of which wheels is individually connected to a corresponding drive motor, and a swinging transom having a lowered central portion for carrying thereon a body of a railway platform vehicle, opposite sides of the swinging transom being connected by first vertical suspensions to two box-shaped elements positioned at, and interconnected to opposite sides, respectively, of said frame each of said box-shaped elements pivotally supporting thereon for pivotal movement in opposite directions in a plane parallel to the direction of movement of said bogie, two generally U-shaped arms each rotatably supporting thereon one of said wheels, and characterized by the fact that an end of said swinging transom at each side thereof is shaped in the form of an inverted L and fits over an upper surface on one of said box-shaped elements and thus define the aforesaid first suspensions, each of said U-shaped arms comprising a coupling arm connected at one end to its associated U-shaped arm, and directed upwards and pivoted at its opposite end to a second suspension disposed horizontally on an upper surface of one of the box-shaped elements.

2. Bogie as claimed in claim 1, characterized by the fact that said corresponding motor of each wheel is secured to the upper surface of the associated box-shaped element and is connected to the associated wheel by interposition of a homokinetic flexible coupling shaft and a reduction gear casing supported by the U-shaped arm holding said wheel.

3. Bogie as claimed in claim 2, characterized by the fact that said motors are disposed with their axes of rotation parallel to the direction of movement of said bogie.

4. Bogie as claimed in claim 1, characterized by the fact that, disposed coaxial to each wheel and on the outside of the bogie frame is a disc brake having a shoe that is integral with the U-shaped arm supporting the associated wheel.

5. Bogie as claimed in claim 1, characterized by the fact that the motors are electric motors.

6. Bogie as claimed in claim 2, characterized by the fact that the reduction gear casing comprises a gear reduction unit.

7. Bogie as claimed in claim 2, characterized by the fact that the motors are disposed completely towards the outside of the bogie frame.

* * * * *